US007374051B2

(12) United States Patent
Garceau

(10) Patent No.: US 7,374,051 B2
(45) Date of Patent: May 20, 2008

(54) ELONGATED BOARD VERTICAL HOLDING DEVICE

(76) Inventor: Steven Garceau, 43 Woodside Ct., Watertown, CT (US) 06795

( * ) Notice: Subject to any disclaimer, the term of this patent is extended or adjusted under 35 U.S.C. 154(b) by 13 days.

(21) Appl. No.: 11/336,165

(22) Filed: Jan. 19, 2006

(65) Prior Publication Data

US 2006/0186296 A1 Aug. 24, 2006

Related U.S. Application Data

(60) Provisional application No. 60/656,469, filed on Feb. 24, 2005.

(51) Int. Cl.
*A47G 25/12* (2006.01)

(52) U.S. Cl. ..... 211/63; 211/89.01; 248/113; 248/316.2

(58) Field of Classification Search ..... 211/63, 211/65, 89.01; 248/113, 229.11, 229.12, 248/229.13, 229.22, 229.21, 231.31, 316.2, 248/316.3

See application file for complete search history.

(56) References Cited

U.S. PATENT DOCUMENTS

| | | | |
|---|---|---|---|
| 819,070 | A | 5/1906 | Kenerson |
| 832,104 | A | 10/1906 | Walter |
| 1,141,867 | A | 6/1915 | Daugherty et al. |
| 1,311,089 | A | 7/1919 | Parker |
| 1,329,394 | A | 2/1920 | Fry et al. |
| 1,414,541 | A | 5/1922 | Arey et al. |
| 1,540,803 | A | 6/1925 | Powers |
| 1,686,655 | A | 10/1928 | Ellerbeck |
| 1,825,165 | A | 9/1931 | Smith et al. |
| 2,046,825 | A | 7/1936 | Kneff |
| 2,488,664 | A | 11/1949 | Gruber |
| 2,550,956 | A | 5/1951 | Biery |
| 2,590,297 | A | 3/1952 | Curtis, II |
| 4,134,499 | A | 1/1979 | Joswig |
| 4,222,490 | A | 9/1980 | Wood, Jr. |
| 4,763,797 | A | 8/1988 | Egan |
| 5,303,831 | A | 4/1994 | Miller |

(Continued)

FOREIGN PATENT DOCUMENTS

| | | |
|---|---|---|
| DE | WO 00/03772 | 1/2000 |

(Continued)

*Primary Examiner*—Ramon O Ramirez
(74) *Attorney, Agent, or Firm*—DeLio & Peterson, LLC

(57) ABSTRACT

A device and method are provided for displaying, storing and fixturing snowboards and glider type boards vertically either on the wall or supported from a floor stand. The device allows the quick and easy loading of a board and manipulating or adjusting the board's position. The device has multiple points or surfaces of contact, located on both sides of an elongated board placed in the device, which said points or surfaces may be cushioned, compliant and frictional so as to prevent board damage and to aid in supporting the edges of the board. The contact points provide frictional forces and horizontal vector forces which are the result of the downward gravitational vector force and slight downward movement developed by the weight of the board itself as it is transferred through the multiple contact surfaces. The preferred device employs two arms pivotally connected with the free end of the first arm rotatably secured at the top of the device and the free end of the second arm rotatably secured at the bottom of the device but movable upwards and downwards to adjust the width of the opening between support points.

4 Claims, 12 Drawing Sheets

U.S. PATENT DOCUMENTS

| | | | | |
|---|---|---|---|---|
| 5,601,196 | A | 2/1997 | Heer et al. | |
| 5,992,811 | A * | 11/1999 | McFerren et al. | 248/316.3 |
| 6,402,372 | B1 * | 6/2002 | Saunders | 374/179 |
| 6,827,226 | B2 | 12/2004 | Coulson | |

FOREIGN PATENT DOCUMENTS

| | | |
|---|---|---|
| EP | 0 520 613 A1 | 12/1992 |

* cited by examiner

FIG.1A"

ELONGATED BOARD VERTICAL HOLDING DEVICE

CROSS-REFERENCE TO RELATED APPLICATIONS

This application claims priority to provisional application Ser. No. 60/656,469 filed on Feb. 24, 2005.

BACKGROUND OF THE INVENTION

1. Field of the Invention

The present invention relates generally to the proper storage and display of elongated boards such as snowboards and glider type boards, on the wall or a floor-stand type support structure, which are suspended in a vertical or semi-vertical position at which position the board suffers no distortion type damage during periods of non-use and at which position board graphics and art are oriented and intended to be displayed.

Additionally, this invention affords the board owner and/or manufacturing or pro shop technician a high-tech, and state of the art means of properly clamping and securing the board quickly and easily and for manipulating the board and quickly changing the boards position, for purposes of performing work on the board either to the face, edges, tail, tip and/or bindings that are mounted to the board.

2. Description of Related Art

The ever increasing sport of snowboarding and most recently the continually improving selection of graphics or art work available to the owners of the boards to have applied to their boards has created a need for a device that will hold snowboards firmly, and in a vertical position. Further, it is important to not obstruct the graphics and artwork displayed on the surface of the board thereby prohibiting the board owner from appreciating the visual beauty of the board graphics to its fullest extent. To our knowledge there is no such device available to accomplish this.

Additionally, with much emphasis directed toward board graphics and fine tuning and "tweaking" of binding positions and positions relative to the longitudinal centerline or axis of the board, a need has arisen for the board owner and/or technician to be able to "fixture the board" vertically and at a multiple of positions to perform the application and maintenance process of applying and caring for the graphics and to perform properly the installation and adjusting of the bindings. Again, to our knowledge no such device is available.

Snowboard owners are also concerned about the proper care and storage of their snowboards and the effects on the board from improper storage. Several board manufacturing professionals have advised against hanging boards from their tips, supporting them from their tails or storing them horizontally flat over long periods of non-use as distortion will most likely occur, therefore destroying the performance of the board as it was initially intended. The majority of the devices that are currently available for storing boards use the technique of "standing" the board on its tail or laying the board horizontally across two horizontal supports.

Current art does not address all of these concerns in one comprehensive package, as does this invention, nor does it address these concerns individually as well as this invention, especially with regard to proper storage, positive support, proper display, positive fixturing and ease of manipulation, for the purpose of performing meaningful work to the board.

It is also important that industrial versions intended for pro shops, snowboard and glider board manufacturers, professional snowboard and glider board athletes who work on their own boards, and industries where technicians perform manual labor on relatively narrow and elongated objects, be available, as the unique features of this invention lend themselves readily to commercial use in terms of proper handling of the board and especially in terms of ergonomic correctiveness for the technician working on the board as the invention enables the technician to work on the board without bending over and creating lower back fatigue.

These industrial technical features are not typically associated with a home storage/display unit but rather associated, with a sophisticated pro-shop or manufacturing operation. Additionally, this invention provides the user with an aesthetically pleasing object in the home that is much more than just functional but is in fact a work of art unto itself that has been selected by the user from a variety of designs that all incorporate the same means of operation that the invention encompasses.

Bearing in mind the problems and deficiencies of the prior art, it is therefore an object of the present invention to provide a device which holds an elongated object in a vertical position.

It is another object of the present invention to provide a device that does not damage the elongated object such as a snowboard in that pressure is applied in a relatively uniform fashion to the outer edges of the board, about the midsection or "waist" of the board and does not allow the board to rest on any surface where the weight of the board itself can create enough force to distort and/or reshape the board therefore changing the characteristics of the board thereby destroying the original qualities of the board.

Still other objects and advantages of the invention will in part be obvious and will in part be apparent from the specification.

SUMMARY OF THE INVENTION

The invention is broadly directed to a device for holding elongated objects such as snowboards in a vertical position along its longitudinal axis while exerting one or more horizontal and/or frictional forces to the object along each of the opposed longitudinal edges of the object. In one aspect, horizontal and frictional forces are provided by gravity acting on the weight of the object and in another aspect by one or more spring actuated knobs and/or knobs made of a resilient material.

The above and other objects and advantages, which will be apparent to one of skill in the art, are achieved in the present invention which is directed to, in a first aspect, a device for holding an elongated object such as a snowboard in a vertical position comprising:

- a first arm having a first end and a second end;
- a second arm having a first end and a second end;
- means to rotatably secure the first end of the first arm in the device;
- means to pivotally secure together the second end of the first arm and the second end of the second arm forming a pivot point;
- a first board securing knob extending proximate to and outward from the first end of the first arm;
- a second board securing knob extending proximate to and outward from the first end of the second arm; and
- a third board securing knob extending outward proximate the pivot point;

wherein an elongated object having a first longitudinal edge and a second opposed longitudinal edge is secured in a vertical position in the device along its longitudinal axis wherein the first edge rests against the first knob and the second knob and the second edge rests against the third knob.

In a further aspect of this feature of the invention an elongated support device utilizes a sleeve or collar to hold the second board securing knob slideably to the elongated support plate or other structural member so that when the sleeve moves up and down on the elongated support plate the opening to hold the board is moved outward when the sleeve is moved upward and the opening moved inward when the sleeve is moved downward.

In another aspect of the invention a device is provided for holding an elongated object such as a snowboard in a vertical position comprising:

a first arm having a first end and a second end;

means to rotatably secure the first end of the first arm to the device;

a first board securing knob extending proximate to and extending outward from the first end of the first arm;

a second board securing knob positioned below the first knob forming a plane with the first knob in which the board is desired to be held;

a third board securing knob extending proximate to and extending outward from the second end of the first arm;

wherein an elongated board having a first longitudinal edge and a second longitudinal edge is secured in a vertical position in the plane defined by the first knob and the second knob, the first longitudinal edge of the board resting against the first knob and the second knob and the second longitudinal edge of the board resting against the third knob.

In a further aspect of the invention a device is defined for holding an elongated object such as a snowboard in a vertical position comprising:

a first board securing knob extending outward from the device;

a second board securing knob positioned below the first board securing knob and extending outward from the device and forming a plane with the first knob in which the object is to be held;

a first arm extending from the plane defined by the first knob and second knob, the end of the arm having an outward extending resilient knob or a cam;

wherein an elongated object having a first longitudinal edge and a second longitudinal edge is secured in a vertical position in the device wherein the first longitudinal edge rests against the first knob and second knob and the second longitudinal edge rests against the third knob, which knob has sufficient resiliency or a horizontal force producing cam to keep the board from falling.

In a still further aspect of the invention a device is provided for holding an elongated board such as a snowboard in a vertical position comprising:

a first board securing knob extending outward from the device;

a second board securing knob extending outward from the device and positioned below the first knob the two knobs forming a plane in which the board is to be held along its longitudinal axis;

a first arm extending from the plane defined by the first knob and the second knob, the end of the arm having an outward extending third knob which is resiliently moveable back and forth along the longitudinal axis of the arm;

wherein an elongated board having a first longitudinal edge and a second longitudinal edge is secured in a vertical position in the device along the longitudinal axis of the board wherein the first longitudinal edge rests against the first knob and the second knob and the second longitudinal edge rests against the third knob.

With the use of this invention the board owner can proudly display their board or boards in their bedroom, great room, recreation room, sport room, lodge, etc., enjoy the visual beauty of the board and the high tech look and feel of the invention while remaining confident that their board is safely, securely and properly held so as to avoid board damage and possible personal injury in the event of the board falling over, and additionally, use the invention as a technical aid to fixture and manipulate the board while performing work on the board.

The invention can also be used in garages and basements although the visual beauty of the invention may persuade users to install them indoors which is where board manufacturing professionals advise that snowboards be stored to avoid board damage resulting from seasonal and environmental changes.

The invention would also be used by pro shops and other retailers involved in the business of selling boards and related equipment for the purpose of displaying boards. It would also be used by Ski Lodges that might want to display boards in their gathering areas and/or to allow patrons a place to store their boards while not in use. One particular version of the invention lends itself readily to locking the user's board in place therefore preventing theft.

The invention accommodates boards of all sizes with no adjustment from the user making the use of the invention a quick and pleasurable experience. The very experience of using the invention stimulates the users mind and provokes technical thought processes regarding the simple yet very interesting linkage that plays a large part in the suspension of the board.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1A' is a top view of another bumper which can be used with the device.

FIG. 1A" is a plan view of FIG. 1A'.

FIG. 10A is a sectional view of FIG. 10 taken along line 10A-10A.

DESCRIPTION OF THE PREFERRED EMBODIMENT(S)

In describing the preferred embodiment of the present invention, reference will be made herein to FIGS. 1-10C of the drawings in which like numerals refer to like features of the invention.

Figure 1:
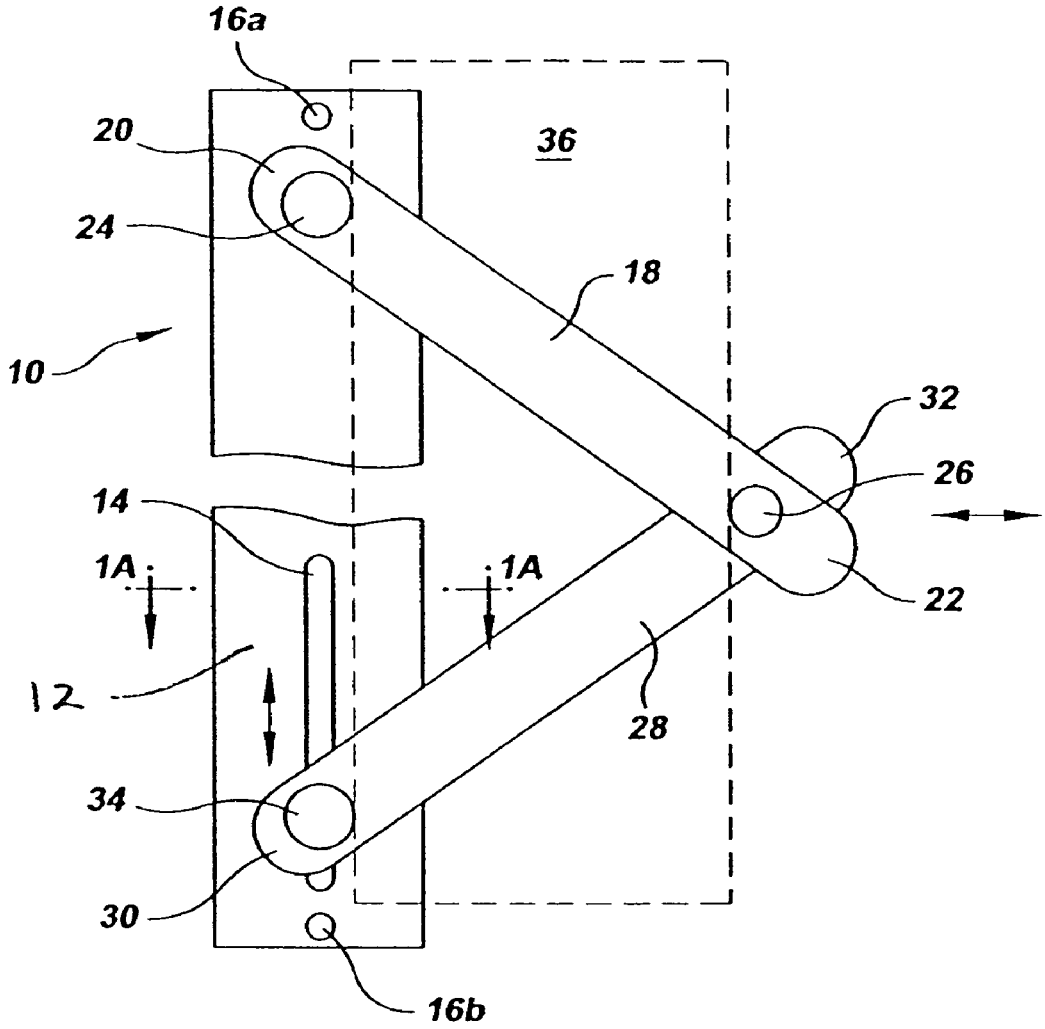
FIG. 1 is a plan view of a device of the invention showing two arms which are pivoted and three knobs used to support and hold an elongated board in a vertical position.

Broadly stated, a snowboard or glider type board suspension device is provided as shown in FIG. 1 that is comprised of a vertical or semi-vertical backing or base of varying shapes including but not limited to; rectangles, triangles, radii, blended arcs which are used to create artistic designs such as but not limited to; T shapes and L shapes, all of which may or may not incorporate graphic images about their surfaces.

In one aspect, a device is provided wherein two pivotal link arms, one mounted to the backing or base at a fixed location toward the top of the backing and one mounted to a captive slider which resides in a track or as a sleeve or collar toward the lower half of the backing. Both link arms being fixed by means of threaded studs which are protruding from frictional knobs or bumpers. The two rotating link arms are joined together at a common pivot point at the opposite ends of that which are attached to the backing and slider, both being attached with a threaded stud that is protruding from a third frictional bumper. The captive slider is mounted in a track, which runs longitudinally about the centerline of the backing or as a sleeve or collar which fits over the backing. The lower link arm being mounted to the slider allows for a scissor action of the two link arms when the slider assembly is raised and lowered.

A snowboard suspension device of this design has the following method of use:

The user with both hands holding the snowboard, lifts the snowboard toward the device and pushes one edge of the snowboard into the frictional bumper that is located at the link arm pivot point thus creating outward force on the link arms causing the slider to move upward in the track or on the backing resulting in an increased horizontal opening of the device allowing the user to now push the snowboard back against the link arms. The user then starts to lower the snowboard and releases the grip on the snowboard while the device closes and makes contact with both longitudinal edges of the board. The gravitational effect of the board trying to fall and the holding effect of the friction bumpers has on the snowboard causes the slider to move downward slightly thus creating tension on the link arms therefore closing up and squeezing the snowboard therefore suspending it.

Optional Method of Use:

The user either raises the lowermost frictional bumper or applies outward horizontal force to the frictional bumper located at the link arm pivot point therefore opening the device to accept the snowboard. The user then using their other hand places the board against the backing or base and releases their grip on the frictional bumper that they used to open the device which through the scissor action of the link arms forces the frictional bombers into contact with the board.

The operator then releases their hold on the board thus allowing the board suspension device to perform the work of suspending the board.

Referring now to FIG. 1, a device of the invention is shown generally as numeral 10. The device comprises a support plate 12 which has a vertical slot 14 in the lower end of the plate. Mounting holes 16*a* and 16*b* is at the top and bottom of the support plate, respectively, to hold the device to a wall or support stand. The device comprises a first arm 18 having a first end 20 and a second end 22. A first support knob 24 is rotatably secured at the first end of the arm. At the second end of the first arm is a pivot point knob 26 which is pivotally connected to a second arm 28. The second arm 28 has a first end 30 and a second end 32. A second support knob 34 is positioned at the first end 30 of the second arm and moves upward and downward in slot 14. An elongate board 36 is shown held vertically by the device.

To use the device, one method is to move the lower second support knob 34 upward in slot 14 which moves pivot point knob 26 to the right away from support plate 12. When the desired width is achieved, which width is wider than the elongated board 36, one longitudinal edge of the board is placed against first knob 24 and second knob 34 and then the second knob 34 moves downward so that the other edge engages pivot point knob 26. This locks the board in a vertical position with the board being supported by gravity (forming horizontal forces) and by frictional forces exerted by knobs 24, 34 and 26.

To release the board from the device, lower second knob 34 is raised in slot 14 thus disengaging the board.

Figure 1A:
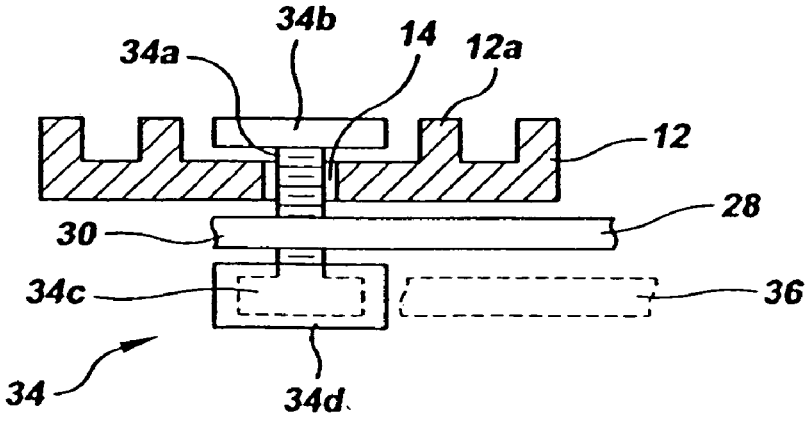
FIG. 1A is a cross-sectional view of FIG. 1 along lines 1A-1A.
Figure 1A:
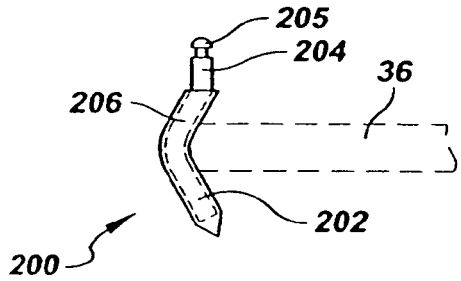
Figure 1A:
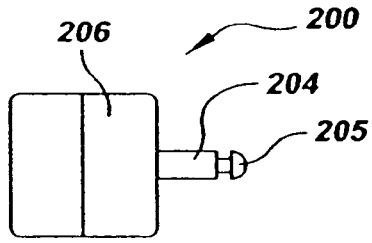

FIG. 1A shows lower second knob 34 having a steel core 34*c*, a rubber sheath 34*d*, a threaded shank 34*a* and a nut 34*b*. The shank passes through slot 14 and the nut holds the knob 34 slideably secure in the support plate 12. The support plate and arms may be any suitable structural material such as wood, metal, or plastic. An extruded aluminum plate having support ribs 12*a* is preferred. The thickness of the plate including the ribs is about ¾ to 1 inch. A slot would be formed in the plate as shown in the figure.

The knobs (24, 26 and 34) are preferably round but may be rectangular as shown in FIGS. 1A', 1A" and 5-6B. Typically they are about 1-3 inch in diameter or more and about 1-3 inch thick or more. They are made of a resilient material such as polyurethane and rubber with a steel core and provide a frictional retention force.

FIG. 1A' shows another bumper 200 which is concave in shape. FIG. 1A" shows the bumper being essentially rectangular. These bumpers offer certain advantages over the round bumpers but the round bumpers are shown in the figures for convenience. Bumper 200 has a steel core 202, a steel shank 204 and a rubber sheath 206. A knob 205 can be used at the end of shank 204 for connection to a support plate instead of a threaded shank/nut connection.

Figure 8:
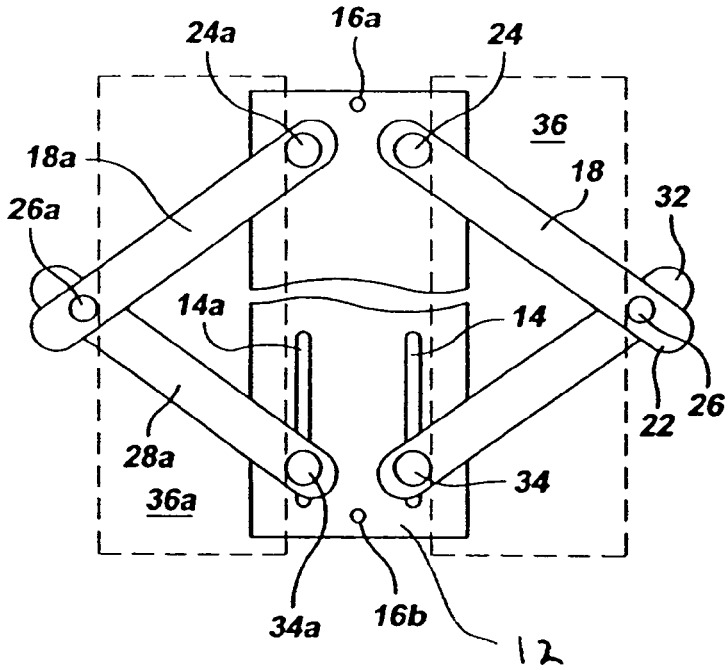
FIG. 8 is a device of the invention which can be used to hold two boards side-by-side.

It will be appreciated that two (2) boards can be held side-by-side by utilizing another device next to the other device as shown in FIG. 8.

Figure 1B:
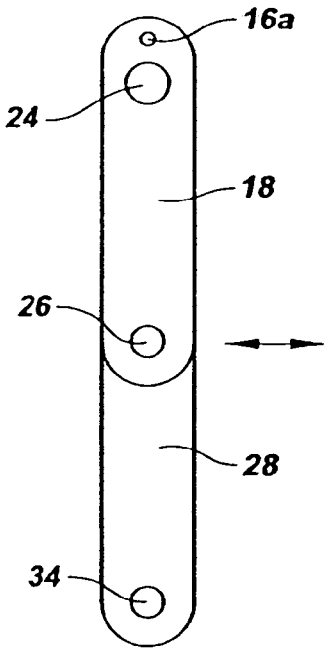
FIG. 1B is the device of FIG. 1 without the support plate.

FIG. 1B shows the device of FIG. 1 without a support plate and slot.

Figure 1C:
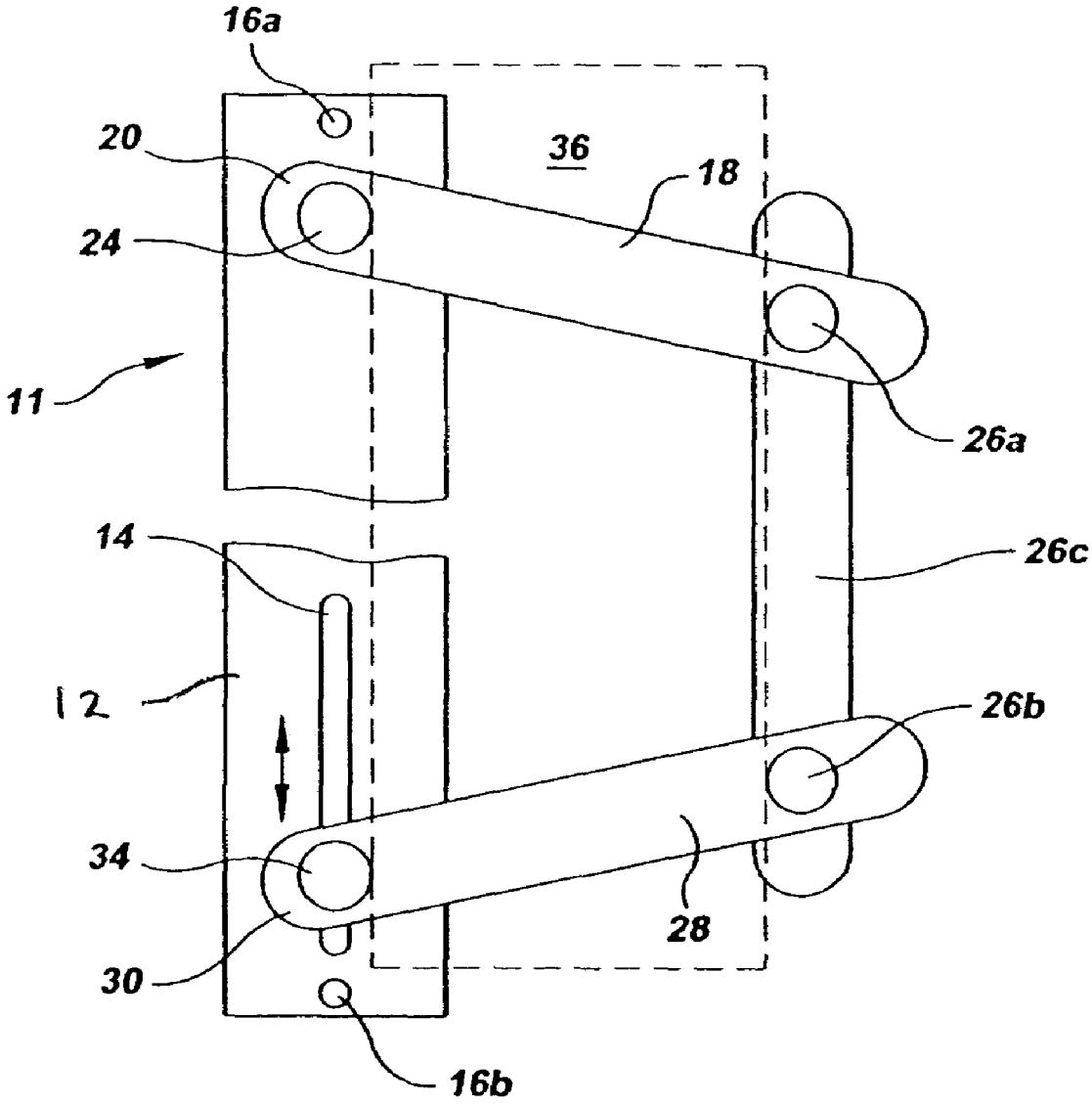
FIG. 1C is the device of FIG. 1 using two pivot points.

FIG. 1C shows the device of FIG. 1 with another arm 26*c* and two knobs 26*a* and 26*b* instead of one knob 26.

Figure 2:
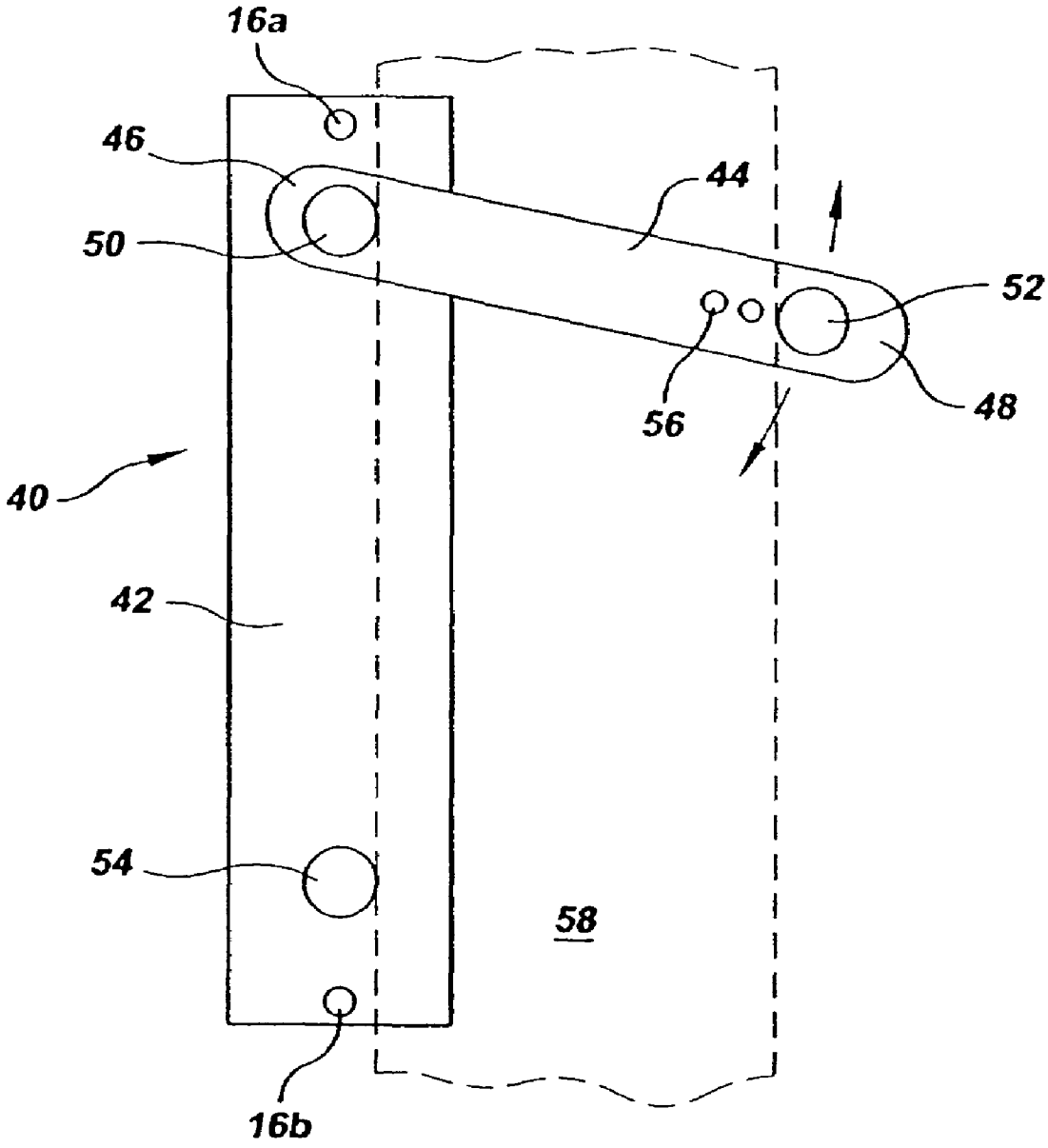
FIG. 2 is another device of the invention showing two fixed knobs to hold and support one edge of an elongated board in a vertical position and one pivotable arm which has a knob at its end for holding the other edge of the elongated board.

Referring now to FIG. 2, another device of the invention is shown as numeral 40. In this device support plate 42 utilizes a support arm 44 which is fixed and pivotable at the first end 46 around knob 50. The second end of the arm 48 has a second end knob 52. Also provided in the arm are openings 56 to secure knob 52 in any of the openings thereby adjusting the effective length and horizontal force vector of the arm. At the lower end of the support plate 42 is a fixed knob 54. An elongated board 58 is shown secured in the device. As with FIG. 1, the support plate can be mounted to a wall or held by a stand.

In use, arm 44 would be swung upward thus widening the space between the knobs 50 and 52 with the knob 52 at the end of arm 44. One edge of an elongated board would then be placed against fixed knobs 50 and 54 and then arm 44 moved downward engaging knob 52 with the opposed longitudinal edge of board 58. This locks the board in a vertical position and is held in the device by gravity and frictional forces by knobs 50, 54 and 52.

Additionally, a rotational retention device located at the knob 50 rotation point to hold the arm in position and resist rotational forces introduced by the wedge shape of the snowboard and slippage at the frictional bumpers may be used. This device could take the form of a ratchet/pawl arrangement, a friction washer assembly, a gear tooth and lock arrangement or a spring as well known in the art. Generally, referring to a racket/pawl, arm 18 could be moved upward to a horizontal position and maintained in that position. When the board is in position, the ratchet could be released and the arm 18 moved downward contacting the edge of board 36. The ratchet would keep the arm 18 from moving upward during storage of the board.

Figure 3:
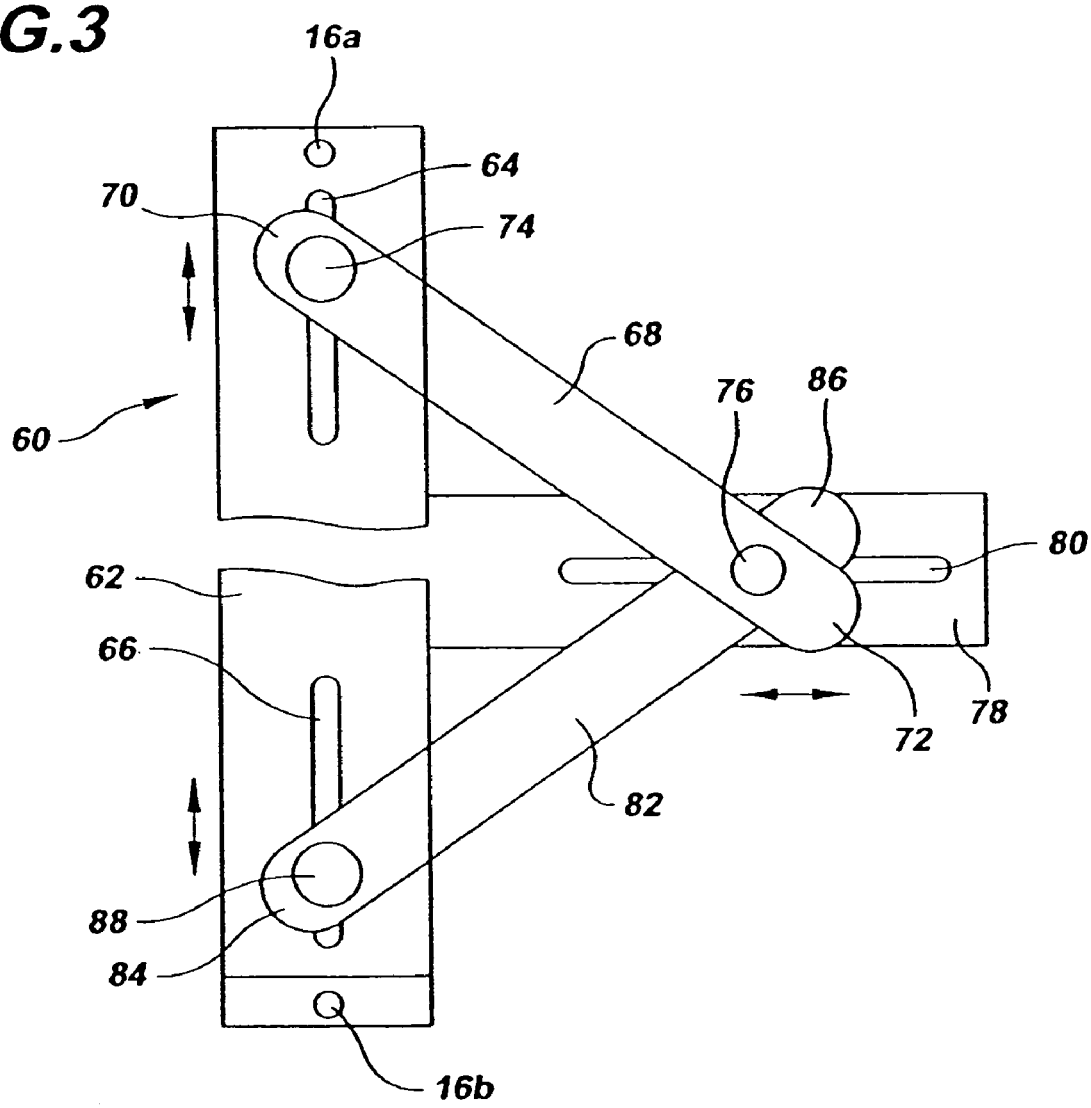
FIG. 3 is another device of the invention similar to FIG. 1 except that each knob is moveable in a slot.

Referring now to FIG. 3, the device 60 is similar to the device of FIG. 1 except that additional slots are provided for limited linear movement of each of the knobs. Thus, a support plate 62 has an upward slot 64 and a lower slot 66. A first arm 68 having a first end 70 and a second end 72 has a knob 74 at the first end of the arm which is moveable up and down within slot 64. At the second of the arm is a pivot point knob 76 which is pivotably connected to a second arm 82. The second arm 82 has a first end 84 and a second end 86. At the second end of each arm the knob 76 provides the pivot point and is pivotally secured and linearly moveable in slot 80. A support plate 78 is shown transverse to support plate 62 and provides support for knob 76 and slot 80. At the other end of second arm 82 is knob 88 which moves upward and downward within slot 66.

In use, knobs 74 and 88 would be moved upward or downward to provide the necessary width between the knobs and the pivot point knob 76 to place an elongated board. Once the elongated board is in position against knobs 74 and 88, the knobs are allowed by gravity to engage one edge of the longitudinal elongated board and the pivot point knob 76 engages the other edge of elongated board holding the board in position by the three knobs.

Figure 4:
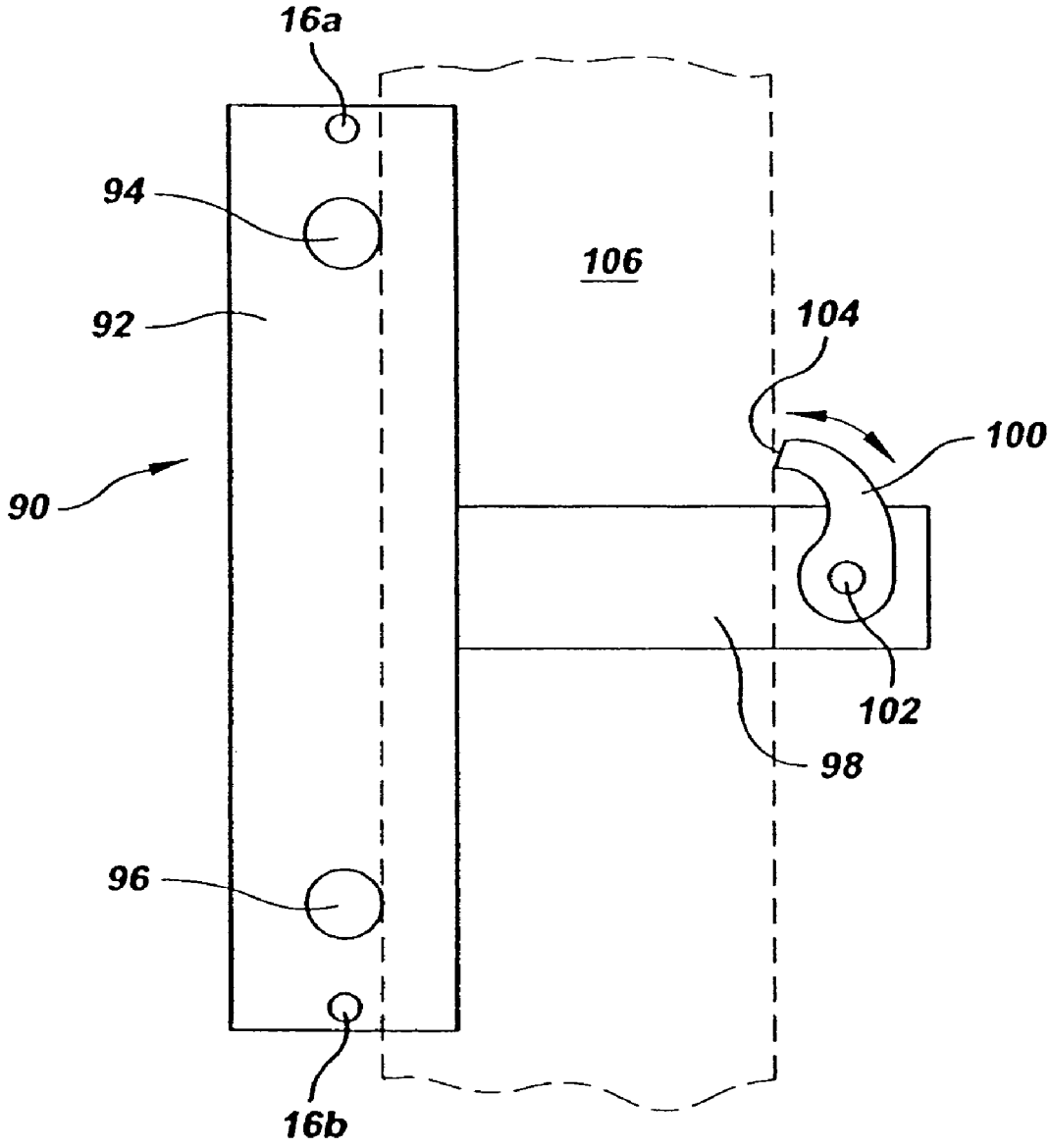
FIG. 4 is another device of the invention showing two vertically spaced fixed knobs to engage one edge of an elongated board and a rotatable cam which engages the other edge of the elongated board to hold the elongated board in a vertical position.

Referring now to FIG. 4, another device of the invention is shown as numeral 90. In this device a support plate 92 has a fixed upper knob 94 and a fixed lower knob 96. A transverse second support plate 98 is shown extending from support plate 92 and supports a cam 100 which is rotatable about pivot point 102. The cam 100 moves as shown by the arrows and, in use, one edge of elongated board 106 would be placed against upper knob 94 and lower knob 96 and then the cam rotated counter-clockwise so that end of the cam 104 engages the other opposed edge of elongated board 106. The board is held in position by gravity and the friction forces exerted by fixed knobs 94 and 96 and cam 104.

Figure 5A:
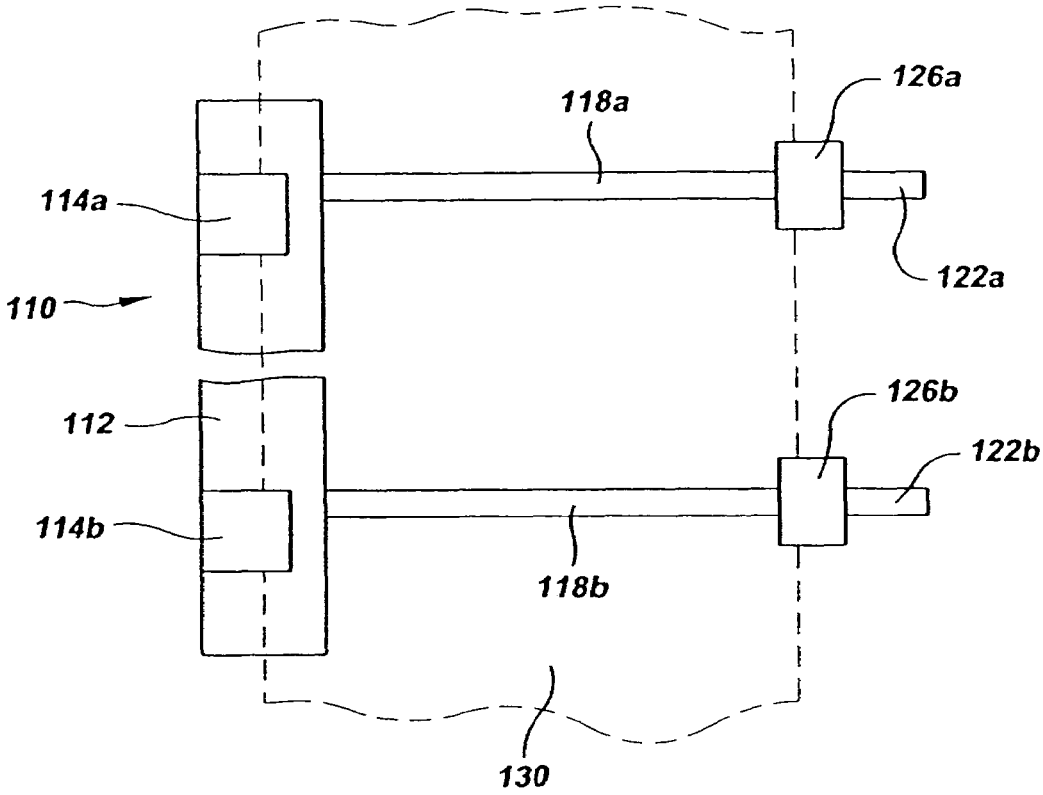
FIG. 5A is another device of the invention showing use of two vertically spaced fixed knobs used in conjunction with respective pivot arms and cradles to hold an elongated board in a vertical position.
Figure 5B:
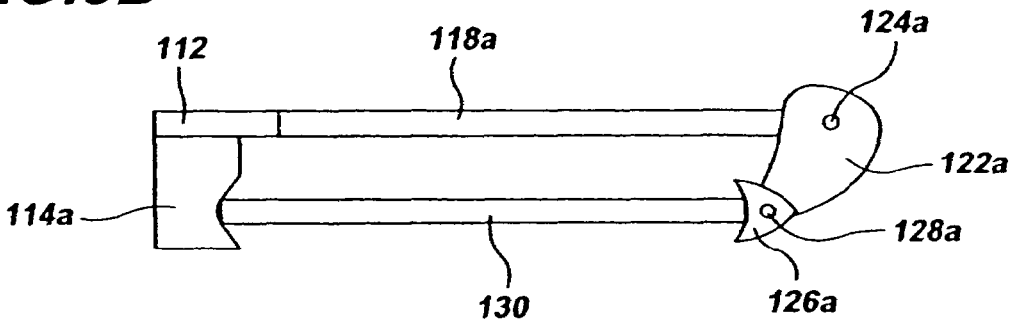
FIG. 5B is a top view of the device of FIG. 5A.

FIGS. 5A and 5B show another device of the invention as numeral 110. This devices uses a vertical support plate 112 to which is attached a fixed upper knob 114*a* and a lower knob 114*b*. An upper horizontal back plate 118*a* is attached to support plate 112 and at its open end comprises a pivotally secured upper arm 122*a* at pivot point 124*a*. At the open end of pivot arm 122*a* is a support cradle 126*a* which is pivotably connected at point 128*a*. Device 110 shows an upper and lower pivot arm device.

In use, the pivot arms 122*a* and 122*b* would rotated counter-clockwise thus widening the space between the fixed knobs 114*a* and 114*b* and the cradle 126*a* and 126*b*. One longitudinal edge of the board is then placed against the fixed knobs 114*a* and 114*b* and the pivot arm would then urge the cradle against the opposed edge of the longitudinal board holding the board 130 in a vertical position as shown in the figure.

FIG. 5B shows a top view of device 110.

Figure 6A:
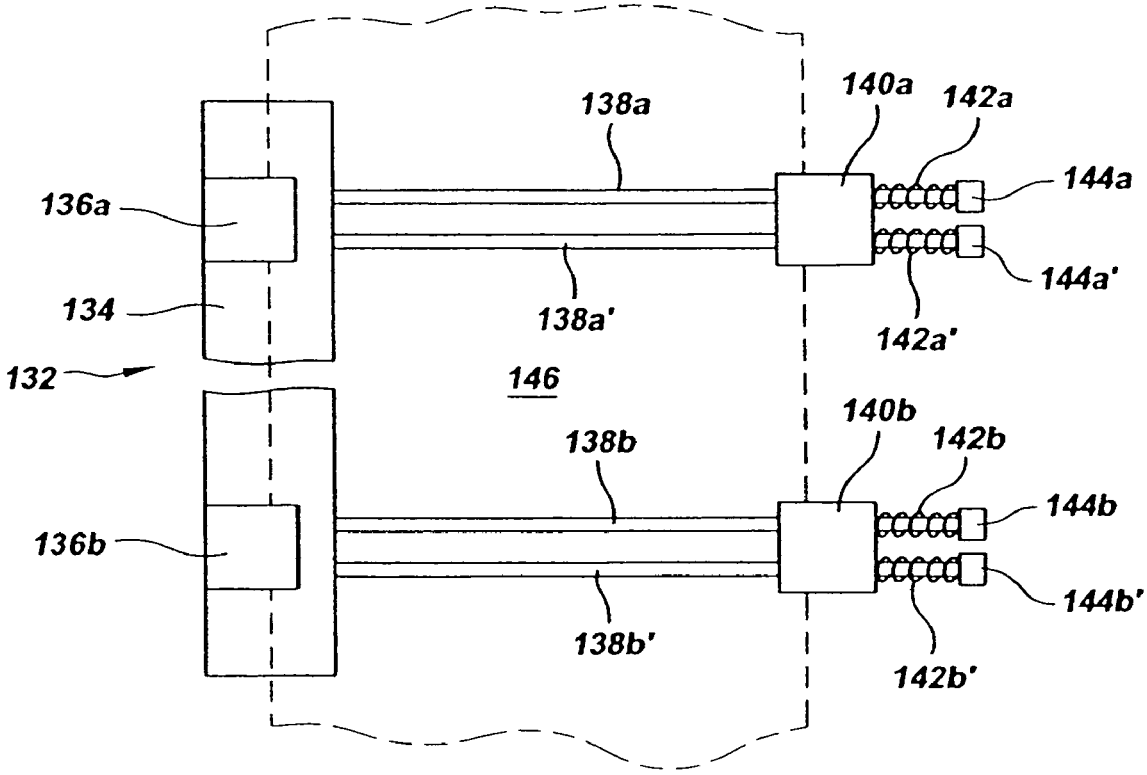
FIG. 6A is another device of the invention showing use of a spring actuated knob to hold one edge of an elongated board and a fixed knob holding the other edge of an elongated board.

FIG. 6A shows another device of the invention as numeral 132 and employs a back plate 134 which in this figure is shown only holding knobs 136*a* and 136*b*. Connecting rods 138*a* and 138*a*' connect the support plate and knob 136*a* to a laterally moveable knob 140*a* which is moveable sideways along the connecting rods. Springs 142*a* and 142*a*' urge the moveable knob 140*a* to the left to engage elongated board 146 as shown in the figure. The device operates similarly for lower knob 136*b*.

Figure 6B:
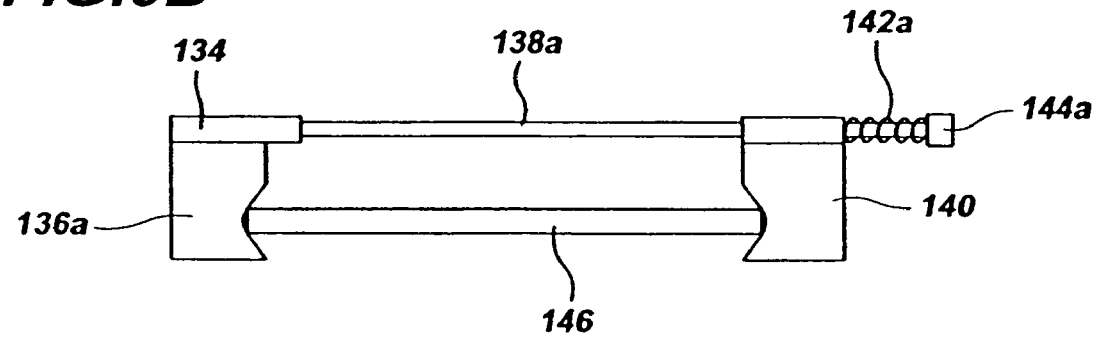
FIG. 6B is a top view of the device of FIG. 6.

A top view of the device 132 is shown in FIG. 6B.

Figure 7:
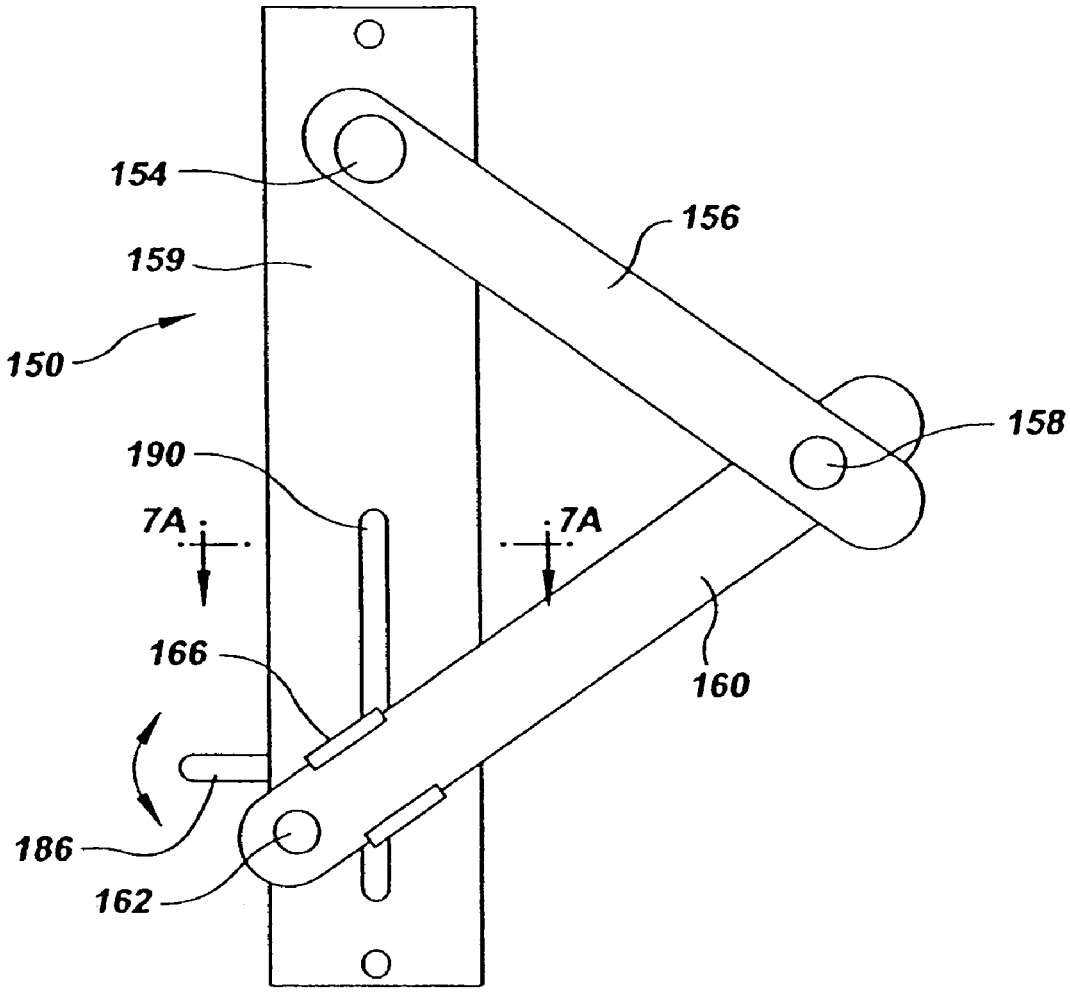
FIG. 7 is another device of the invention.

FIG. 7 is another device of the invention where the lower arm 160 is the sliding member. Thus, upper arm 156 is rotatably connected to plate 159 at bumper 154. Upper arm 156 and lower arm 160 are pivotally connected at bumper 158. The free end of lower arm 160 has a lower bumper 162 and is rotatably connected to plate 159. Lower arm 160 moves through and is slideably secured by rotatable bracket 166.

The purpose of the device of FIG. 7 is that it allows the user to position the board at different attitudes (angles from vertical). The resultant attitude is a function of the distance between bumper 154 and bracket 166. For example, as the distance between bumper 154 and bracket 166 is decreased, the bottom of the board is moved to the left.

Figure 7A:
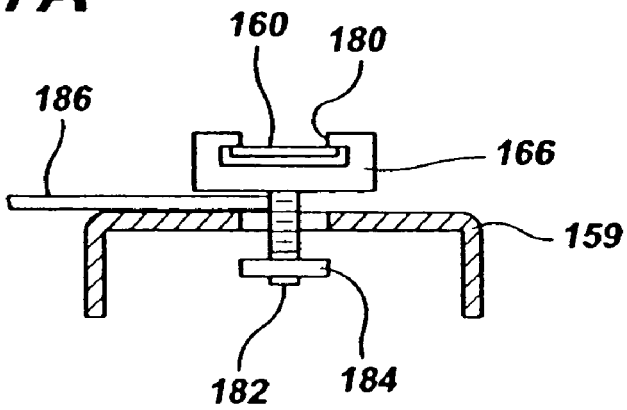
FIG. 7A is a cross-section of FIG. 7 along lines 7A-7A.
Figure 9:
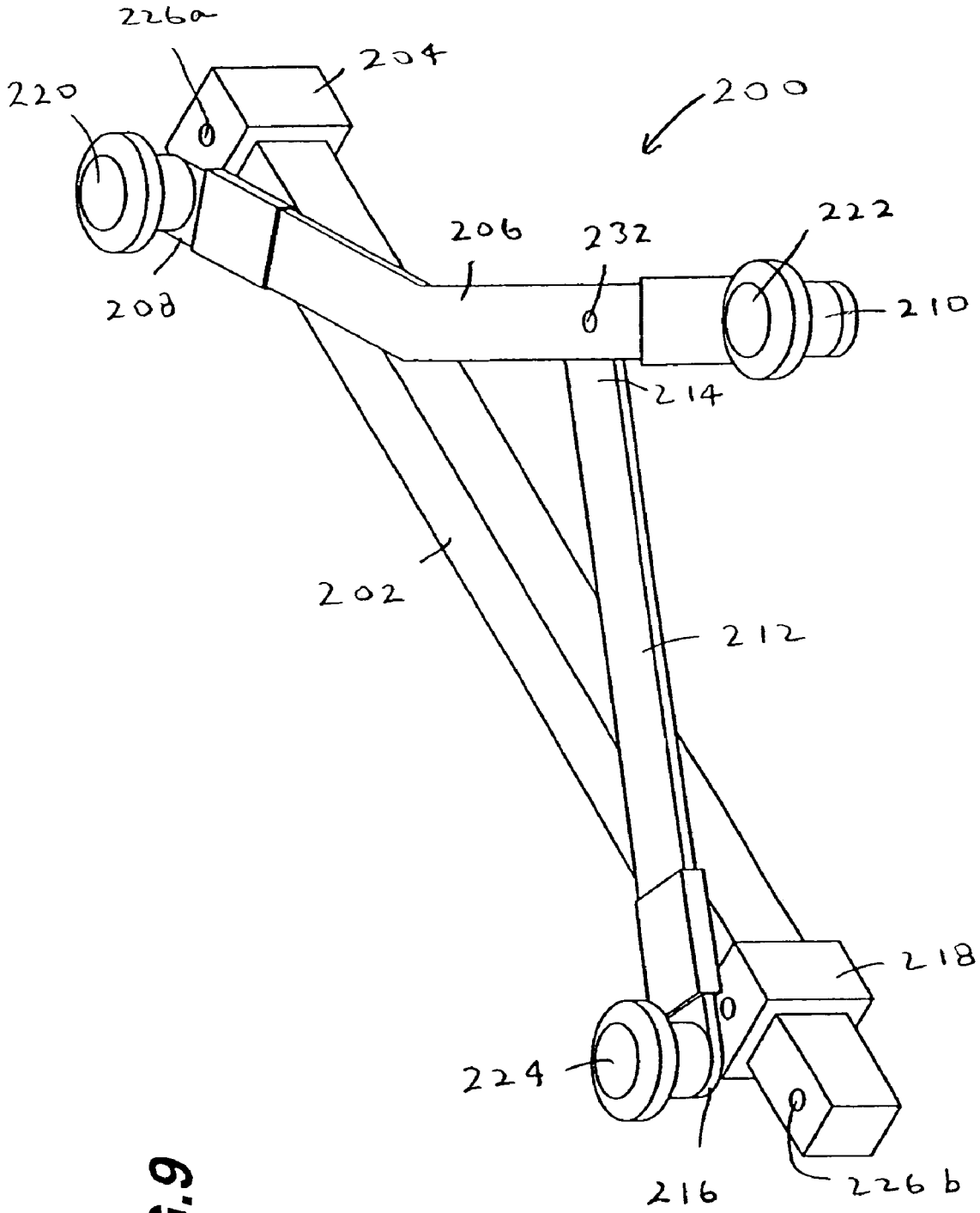
FIG. 9 is a perspective view of another device of the invention.

FIG. 7A shows a cross-section of plate 159 taken along lines 7A-7A. Bracket 166 has a lip 180 to slideably secure arm 160 and a threaded shank 182 slideably secured to plate 159 by nut 184. A wedge lever 186 can be used to fix bracket 166 to plate 159 for ease of moving the bracket up and down in slot 190. A lock can be used with lever 186 and plate 159 to further secure the board.

Referring now to FIGS. 9, 10, and 10A-10C, another device of the invention is shown generally as numeral 200. The device comprises an elongated support 202 which is shown to be rectangular. Mounting holes 226*a* and 226*b* are at the top and bottom of the support, respectively, to hold the device to a wall or other support. The device comprises a first rotatable arm 206 having a first end 208 and a second end 210. A first support knob 220 is secured at the first end of the arm by pin 230 and rubber or other material insert 234. At the second end of the first arm is a third support knob 222. Pivot point 232 pivotally connects the first arm 206 to a second rotatable arm 212. The second arm 212 has a first end 216 and a second end 214. A second support knob 224 is positioned at the first end 216 of the second arm 212 and moves upward and downward along support 202 as shown by the arrows. As the lower support knob 224 moves upward on support 202, knob 222 is moved outward away from the support as shown by the arrows. This is shown more clearly in FIG. 10 which shows lower sleeve support 218 moving upward or downward which moves knob 222 outward or inward depending on the direction that the lower support sleeve 218 is moved.

Operation of the device is the same as that discussed herein for FIG. 1 with the only difference being that the first knob 220 and the second support knob 224 are held by sleeves 204 and 218 respectively. Sleeve 204 is fixedly secured to a wall or other structure. The lower end of the support 202 is affixed to a wall or structure using a screw or other fastener in opening 226*b* in support 202. This enables sleeve 218 to move freely upward or downward to engage the board 228 as discussed above. A spacer may be needed between the support 202 and wall to allow sliding of sleeve 218.

Referring now to FIG. 10A a sectional view of the support 202 and the sleeve 204 surrounding support 202 is shown. The knob 220 is held to the sleeve by pin 230 which allows rotation of first arm 206. A bolt 226C is shown securing the sleeve 204 through opening 226*a* to a wall or other structure.

Figure 10:
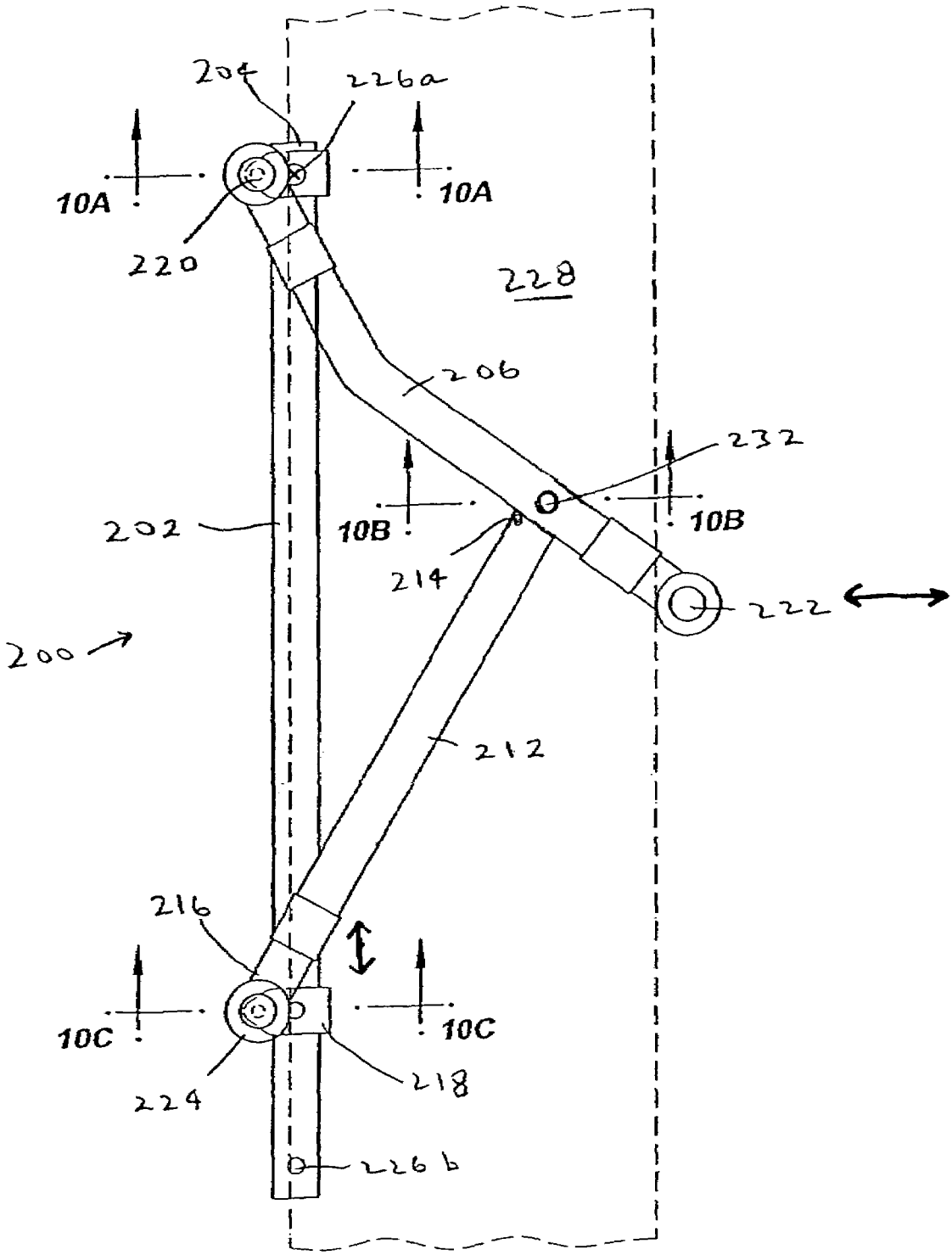
FIG. 10 is a front view of the device of FIG. 9 holding a board in a vertical position.
Figure 10B:
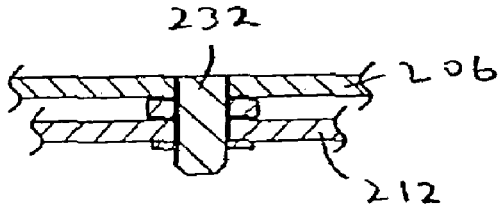
FIG. 10B is a sectional view of FIG. 10 taken along line 10B-10B.

FIG. 10B shows the pivot point 232 with first arm 206 and second arm 212 being pivotally mounted thereto.

Figure 10C:
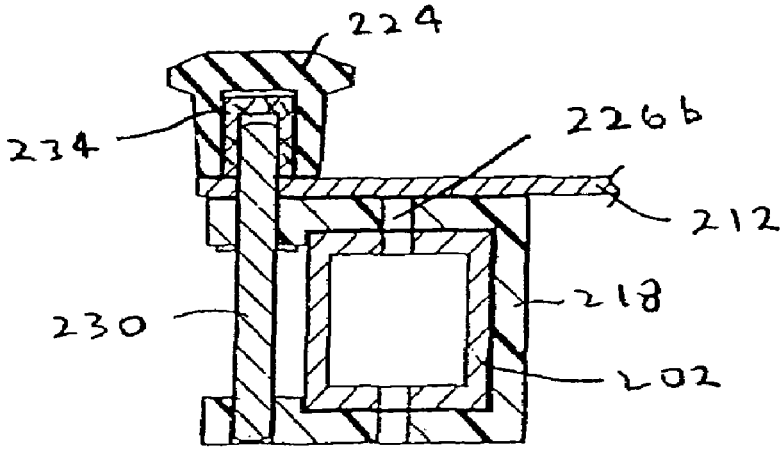
FIG. 10C is a sectional view of FIG. 10 taken along line 10C-10C.

FIG. 10C is similar to FIG. 10A and shows second knob 224 being held to sleeve 218 by pin 230 which allows rotation of second arm 212. The sleeve 218 surrounds support structure 202. Sleeve 218 is not fixedly secured to support 202 as sleeve 204 and sleeve 218 may move upward or downward as shown by the arrow in FIG. 10.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A device for holding an elongated object such as a snowboard in a vertical position comprising:

a first arm having a first end and a second end;

a second arm having a first end and a second end;

means to rotatably secure the first end of the first arm in the device;

means to pivotally secure together the second end of the first arm and the second end of the second arm forming a pivot point;

a first board securing knob extending proximate to and outward from the first end of the first arm;

a second board securing knob extending proximate to and outward from the first end of the second arm; and a third board securing knob extending outward proximate the pivot point;

wherein an elongated object having a first longitudinal edge and a second opposed longitudinal edge is secured in a vertical position in the device along its longitudinal axis wherein the first edge rests against the first knob and the second knob and the second edge rests against the third knob.

2. The device of claim 1 further comprising an elongated support member which is held to a support structure and the first end of the first arm is rotatably secured at the upper end of the support member and the first end of the second arm is rotatably secured at the lower end of the support member and the first end of the second arm can slideably move upward and downward on the support member.

3. The device of claim 2 wherein the first end of the first arm is rotatably secured to the support member by a sleeve which fits over the support member and which sleeve is fixedly secured to the support member and the first end of the second arm is rotatably secured to the support member by a sleeve which fits over the support member and can slide upward or downward on the support member.

4. The device of claim 2 wherein the first end of the second arm moves downward or upward on the support member in a slot in the support member.

* * * * *